US007241159B1

(12) United States Patent
Chen

(10) Patent No.: US 7,241,159 B1
(45) Date of Patent: Jul. 10, 2007

(54) FIXING/GROUNDING UNIT FOR ELECTRONIC CARD

(75) Inventor: Andy Chen, Ban-Chiao (TW)

(73) Assignee: Super Link Electronics Co., Ltd., Taoyuan Hsien (TW)

( * ) Notice: Subject to any disclaimer, the term of this patent is extended or adjusted under 35 U.S.C. 154(b) by 0 days.

(21) Appl. No.: 11/499,734

(22) Filed: Aug. 7, 2006

(51) Int. Cl.
*H01R 13/62* (2006.01)

(52) U.S. Cl. ..... 439/326; 439/92

(58) Field of Classification Search ..... 439/325–329, 439/92–95

See application file for complete search history.

(56) References Cited

U.S. PATENT DOCUMENTS 5,268,820 A * 12/1993 Tseng et al. ..... 439/629
6,971,899 B1 * 12/2005 Liu ..... 439/326
7,134,896 B1 * 11/2006 Chen ..... 439/326
7,182,618 B1 * 2/2007 Choy et al. ..... 439/328

* cited by examiner

*Primary Examiner*—Briggitte R. Hammond
(74) *Attorney, Agent, or Firm*—Rosenberg, Klein & Lee

(57) ABSTRACT

A fixing/grounding unit for electronic card includes a base seat integrally made of metal board. The base seat having a substrate section bridged over a grounding circuit of a circuit board. A middle portion of the substrate section being formed with a transverse fitting cavity. Two chucking members each integrally made of metal board. Each chucking member having a fixing insertion section snugly tightly inserted in each side of the fitting cavity. A resilient pressing projecting section extending from the fixing insertion section, whereby the electronic card can be tightly clamped between the substrate section of the base seat and the resilient pressing projecting section and grounded.

8 Claims, 7 Drawing Sheets

FIXING/GROUNDING UNIT FOR ELECTRONIC CARD

BACKGROUND OF THE INVENTION

1. Field of the Invention

The present invention is related to a fixing/grounding unit for electronic card. The fixing/grounding unit includes a base seat and two independent chucking members respectively plugged in two sides of the base seat for independently fixing and grounding an electronic card.

2. Description of the Prior Art

FIGS. 6 to 9 show an existent fixing/grounding unit for electronic card. The fixing/grounding unit includes: a base seat 71 disposed on a circuit board 60, the base seat 71 having two platform sections 711 on two sides, whereby an electronic card 50 can be bridged between the platform sections 711; a resilient member 72, a middle section of the resilient member 72 being inserted in a middle section of the base seat 71, the resilient member 72 having two hook sections 721*a*, 721*b* on two sides, the hook sections 721*a*, 721*b* being respectively positioned above the platform sections 711 of the base seat 71 and aligned therewith, whereby the electronic card 50 can be resiliently tightly clamped between the hook sections 721*a*, 721*b* and the platform sections 711; and a grounding member 73 having multiple grounding legs 731. The grounding legs 731 pass through the base seat 71 to connect with a corresponding grounding circuit of the circuit board 50. The grounding member 73 is bridged over the resilient member 72 in contact therewith. Accordingly, the electronic card 50 can be grounded via the resilient member 72 and the grounding member 73.

The above fixing/grounding unit has some shortcomings as follows:

1. The resilient member 72 is an elongated bar body. The middle section of the resilient member 72 is inserted in the base seat 71. In the case that the electronic card 50 is inserted in a biased state, the hook section 721*a* of one side of the resilient member 72 will be first pressed and biased as shown by the phantom line of FIG. 8. The resilient member 72 is integrally formed so that when the hook section 721*a* is biased, the other hook section 721*b* on the other side is biased in a reverse direction. The hook section 721*b* will be displaced into the path of the electronic card 50 to hinder the electronic card 50 from being smoothly installed. Therefore, a user needs to apply a greater force onto the electronic card for installing the same.

2. The base seat 71 is integrally made from plastic material by molding. Therefore, the height of the platform sections 711 of the base seat 71 is unchangeable. In the case that the electronic card 50 needs to be bridged in a different height due to different design of a different manufacturer, it will be necessary for the producer to develop another set of injection molds for forming the platform sections 711 with a different height. Due to the change of the height, the length of the grounding legs 731 of the grounding member 73 must be changed with the height of the platform sections 711. Therefore, the grounding member 73 also needs to be redesigned. This inevitably increases the manufacturing cost.

3. The grounding member 73 is bridged over the resilient member 72 to contact therewith. However, the grounding member 73 often fails to truly contact with the resilient member 72. As a result, the electronic card 50 cannot be truly grounded. This will affect the normal operation of the electronic card 50.

SUMMARY OF THE INVENTION

It is therefore a primary object of the present invention to provide a fixing/grounding unit for electronic card. The fixing/grounding unit includes: a base seat integrally made of metal board, the base seat having a substrate section bridged over a grounding circuit of a circuit board, a middle portion of the substrate section being formed with a transverse fitting cavity; a first chucking member integrally made of metal board, the first chucking member having a fixing insertion section snugly tightly inserted in a first side of the fitting cavity of the base seat, a resilient pressing projecting section extending from the fixing insertion section, whereby an edge of the electronic card can be tightly clamped between the substrate section of the base seat and the resilient pressing projecting section; and a second chucking member integrally made of metal board, the second chucking member having a fixing insertion section snugly tightly inserted in a second side of the fitting cavity of the base seat, a resilient pressing projecting section extending from the fixing insertion section, whereby an edge of the electronic card can be tightly clamped between the substrate section of the base seat and the resilient pressing projecting section. The electronic card can be firmly fixed and directly grounded via the fixing/grounding unit.

The fixing/grounding unit for the electronic card of the present invention has the following advantages:

1. The base seat, the first chucking member and the second chucking member are all made from metal board. In addition, the first and second chucking members are resiliently tightly latched with the base seat so that the grounding effect is stable and good.

2. The first and second chucking members are respectively independently plugged in two sides of the fitting cavity of the base seat. Therefore, the first and second chucking members are not easy to deform. In addition, the electronic card will not be hindered from being installed and can be more smoothly placed in.

3. The structure is simple and the components are easy to assemble.

4. The base seat and the first and second chucking members are all made from metal board and have better strength. Therefore, the using life is longer.

5. In the case that the electronic card is required to be installed at a different height, in manufacturing, a manufacturer only needs to change the size of the material of the platform sections. Accordingly, the material with a different size can be bent into a platform section with a different height to meet the requirement. In contrast to the conventional fixing/grounding unit for the electronic card, it is unnecessary to develop another set of injection molds for forming the plastic platform sections with a different height and redesign the grounding member 73 in accordance with the platform section 111. Therefore, the manufacturing cost can be lowered.

The present invention can be best understood through the following description and accompanying drawings wherein:

DETAILED DESCRIPTION OF THE PREFERRED EMBODIMENTS

Figure 1:
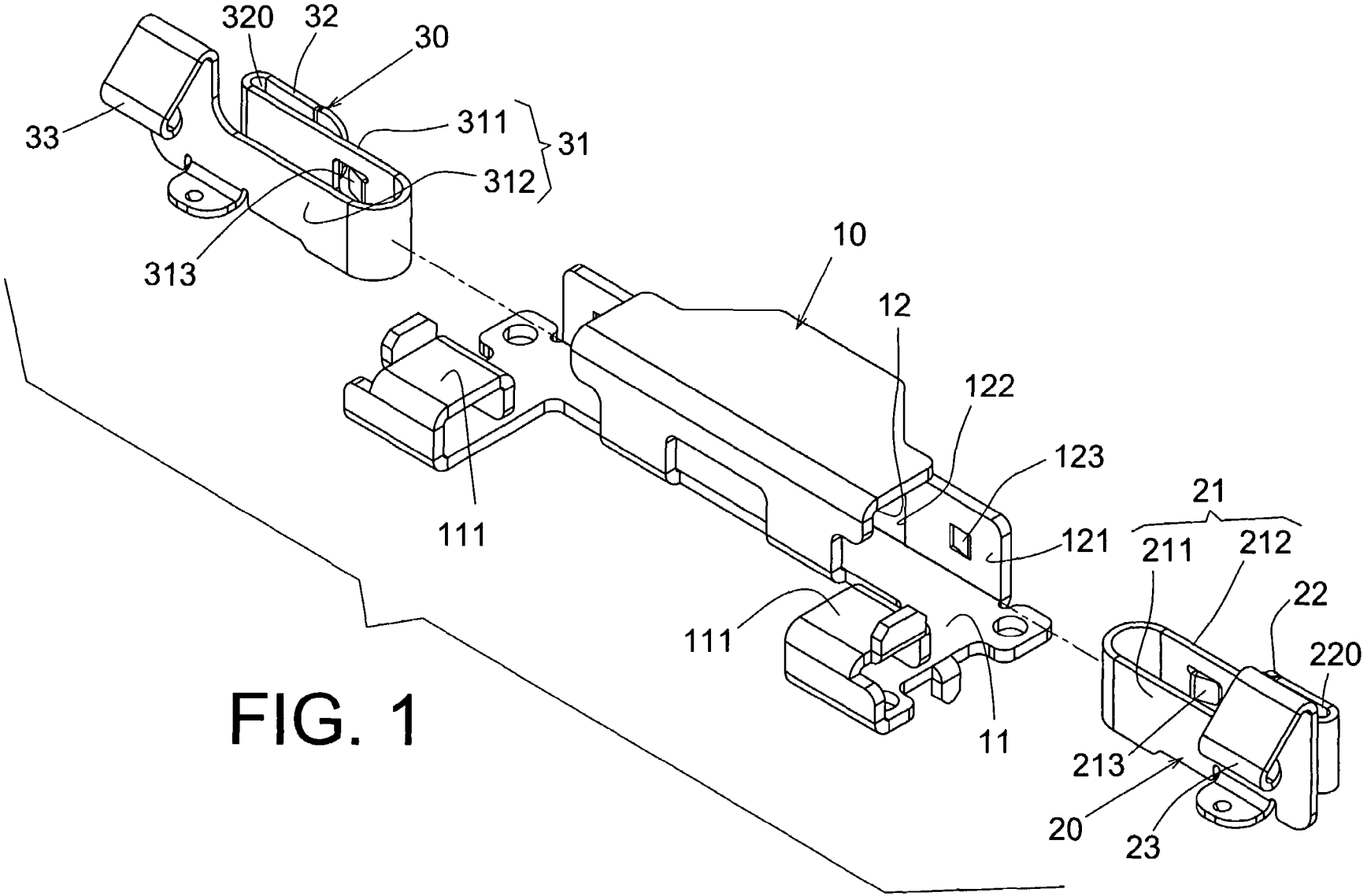
FIG. 1 is a perspective exploded view of the present invention.

Please refer to FIGS. 1 to 5. The fixing/grounding unit for electronic card of the present invention includes: a base seat 10 integrally made of metal board, the base seat 10 having a substrate section 11 bridged over a grounding circuit of a circuit board 60, a middle portion of the substrate section 11 being formed with a transverse fitting cavity 12; a first chucking member 20 integrally made of metal board, the first chucking member 20 having a fixing insertion section 21 snugly tightly inserted in a first side of the fitting cavity 12 of the base seat 10, a resilient pressing projecting section 23 extending from the fixing insertion section 21, whereby an electronic card 50 can be tightly clamped between the substrate section 11 of the base seat 10 and the resilient pressing projecting section 23; and a second chucking member 30 integrally made of metal board, the second chucking member 30 having a fixing insertion section 31 snugly tightly inserted in a second side of the fitting cavity 12 of the base seat 10, a resilient pressing projecting section 33 extending from the fixing insertion section 31, whereby the electronic card 50 can be tightly clamped between the substrate section 11 of the base seat 10 and the resilient pressing projecting section 33. The electronic card 50 is also pushed toward a terminal connector 40 of the circuit board 60 to stably electrically connect with the terminal connector 40. Accordingly, the electronic card 50 is not only tightly clamped and firmly fixed, but also directly grounded via the circuit board 60.

Figure 3:
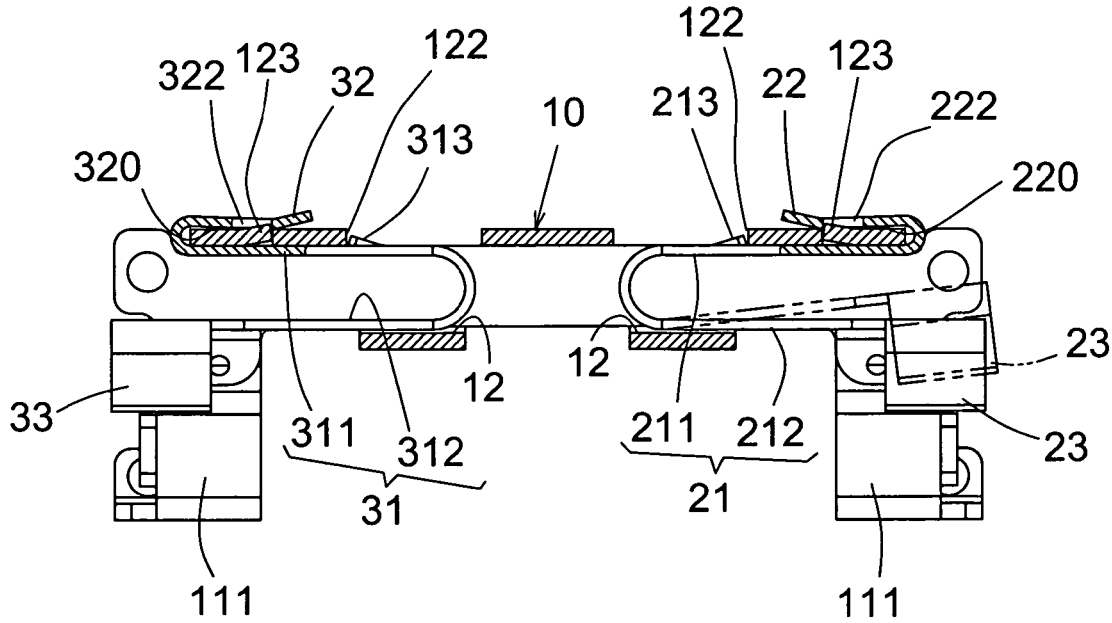
FIG. 3 is a sectional view taken along line 3-3 of FIG. 2.
Figure 4:
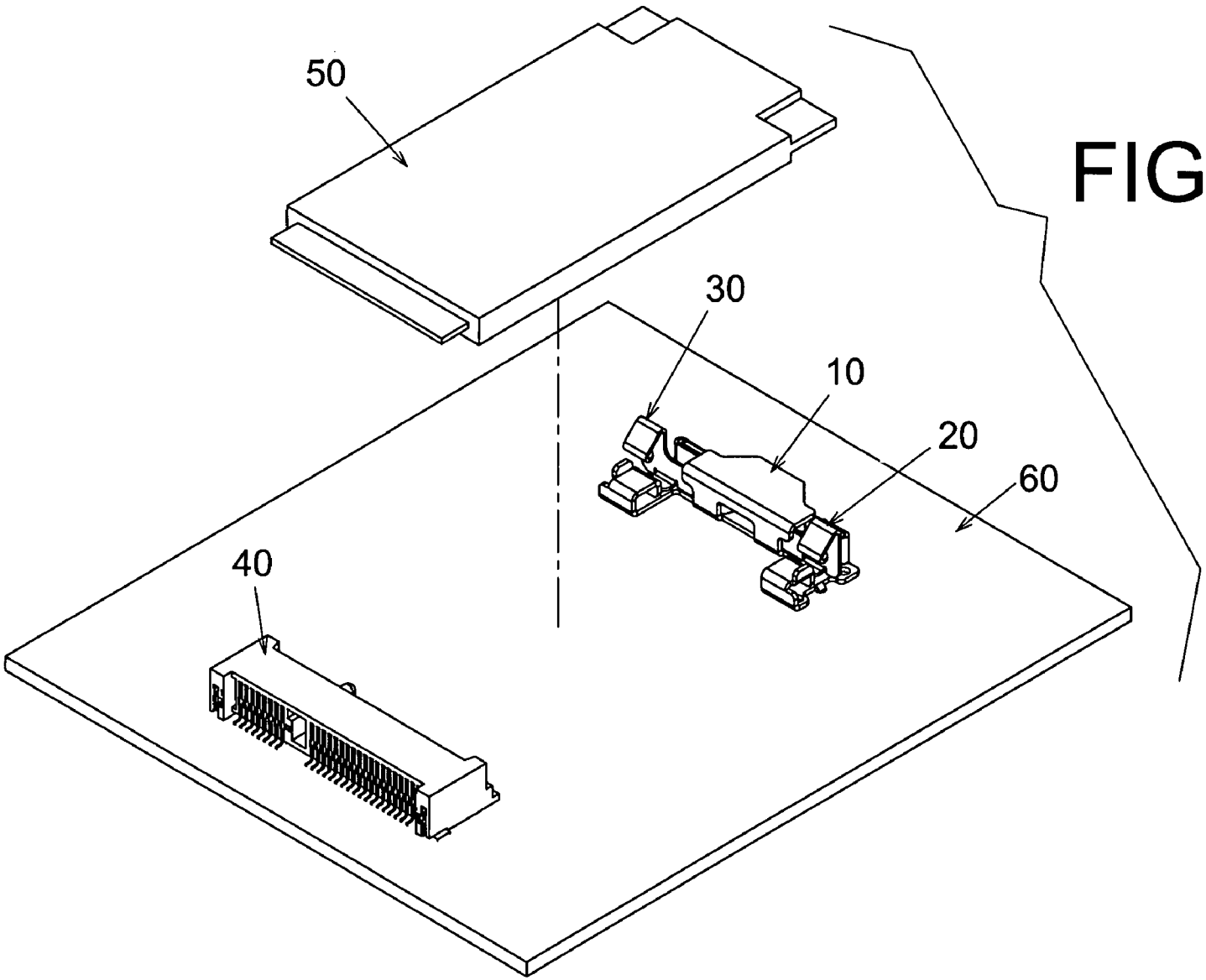
FIG. 4 shows that the present invention is installed on a circuit board.
Figure 5:
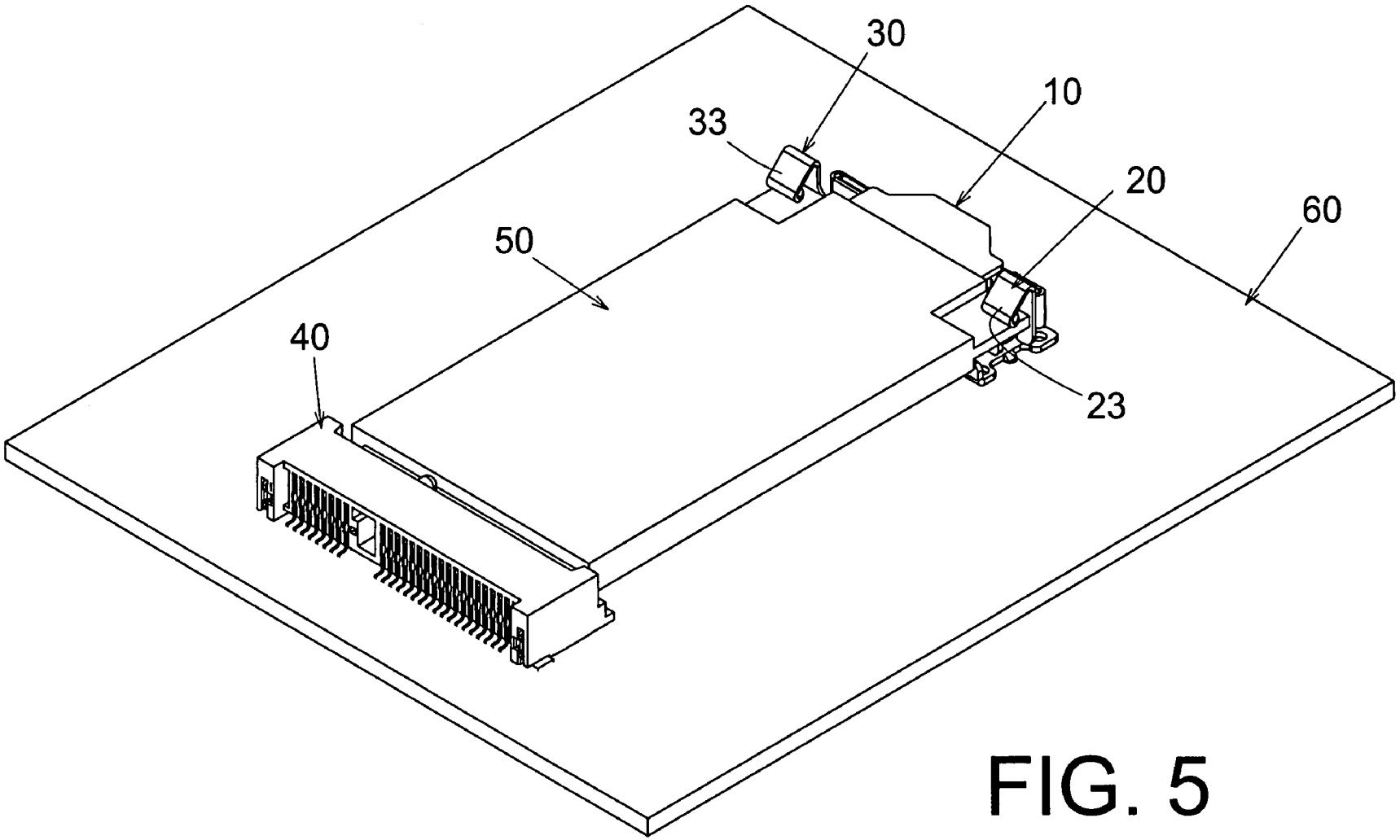
FIG. 5 shows that an electronic card is chucked by the fixing/grounding unit of the present invention.

Referring to FIGS. 1 and 3, two sides of a wall 121 of the fitting cavity 12 are respectively formed with latch holes 122. The first and second chucking members 20, 30 are respectively formed with locating latch hooks 213, 313 corresponding to the latch holes 122. Accordingly, the locating latch hooks 213, 313 of the first and second chucking members 20, 30 can be latched in the latch holes 122 to prevent the first and second chucking members 20, 30 from being extracted out of the fitting cavity 12.

In addition, two sides of the wall 121 of the fitting cavity 12 are formed with locating projections 123. The first and second chucking members 20, 30 are respectively formed with latch holes 222, 322 corresponding to the locating projections 123. Accordingly, the locating projections 123 can be latched in the latch holes 222, 322 of the first and second chucking members 20, 30 to prevent the first and second chucking members 20, 30 from being extracted out of the fitting cavity 12.

Figure 6:
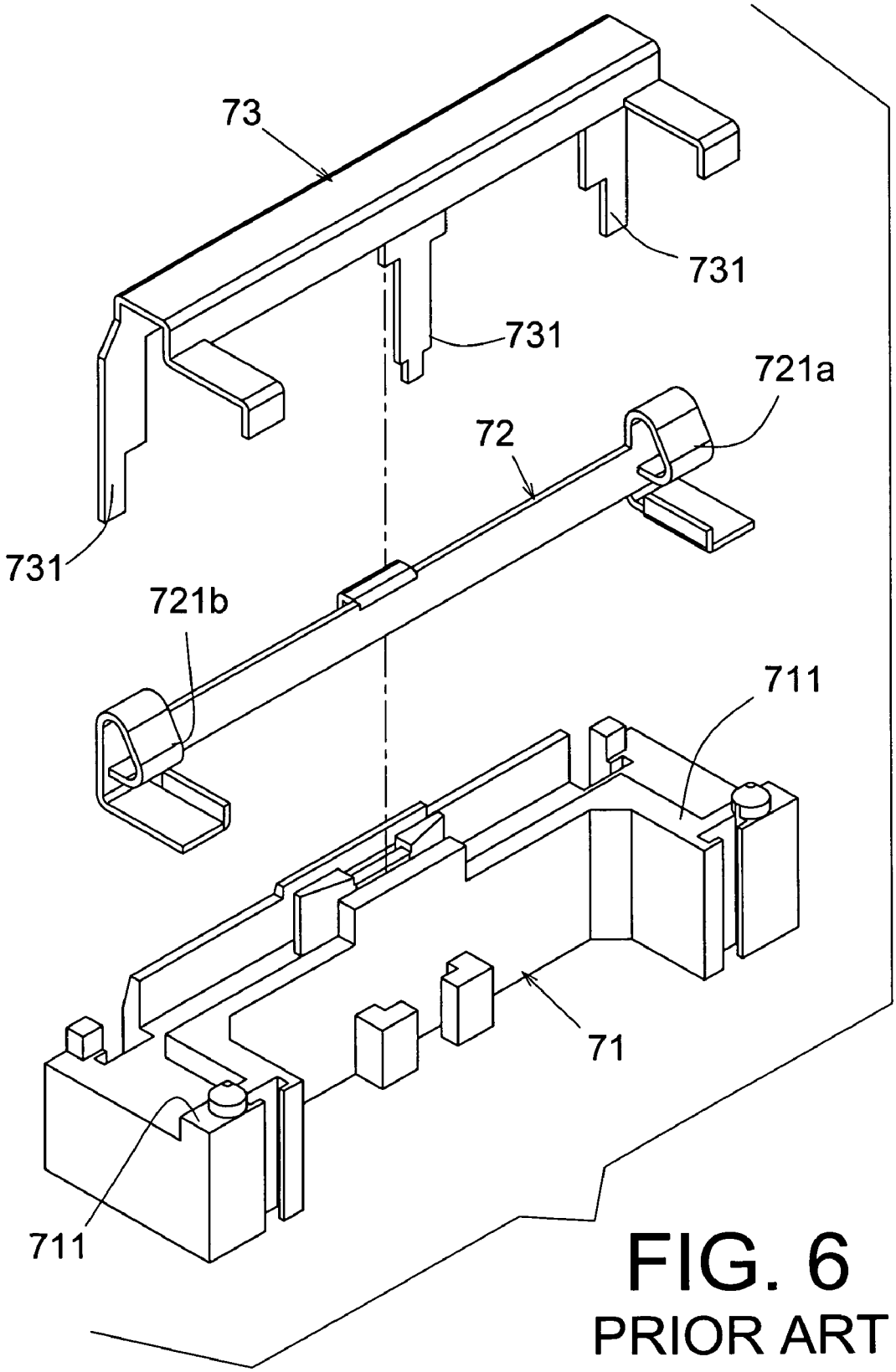
FIG. 6 PRIOR ART
FIG. 6 is a perspective exploded view of the conventional fixing/grounding unit for electronic card.
Figure 7:
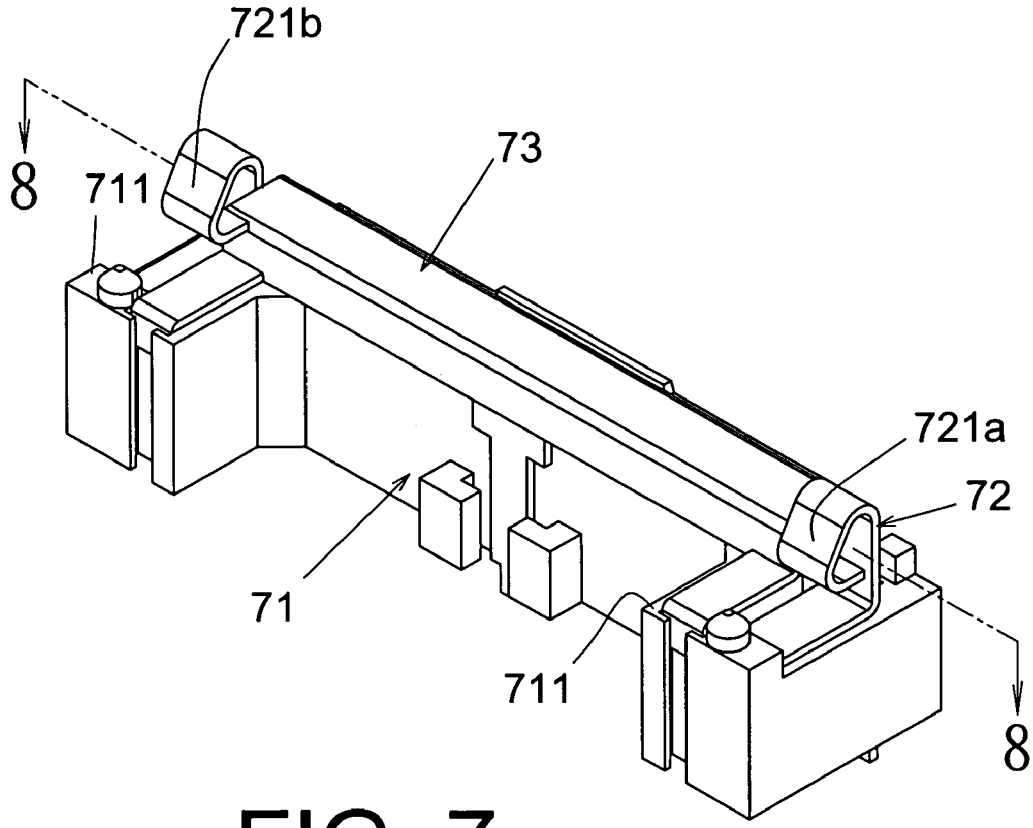
FIG. 7 PRIOR ART
FIG. 7 is a perspective assembled view of the conventional fixing/grounding unit for electronic card.
Figure 8:
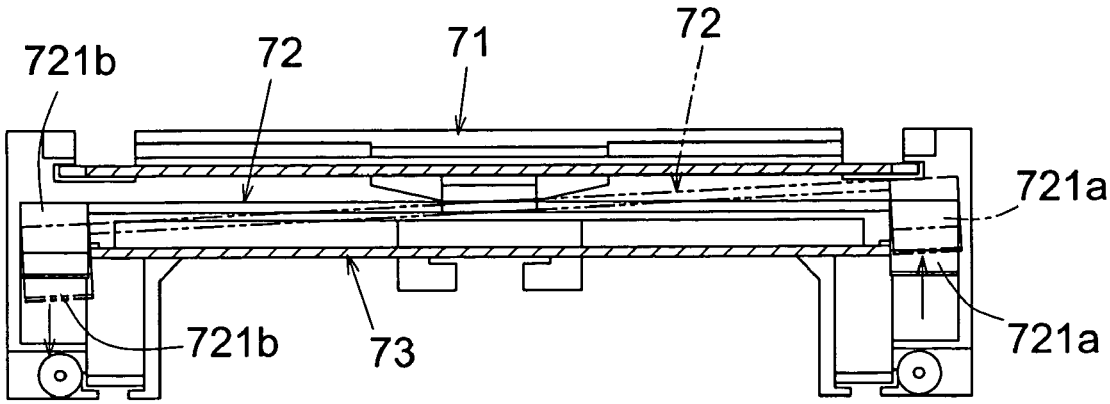
FIG. 8 PRIOR ART
FIG. 8 is a sectional view taken along line 8-8 of FIG. 7.
Figure 9:
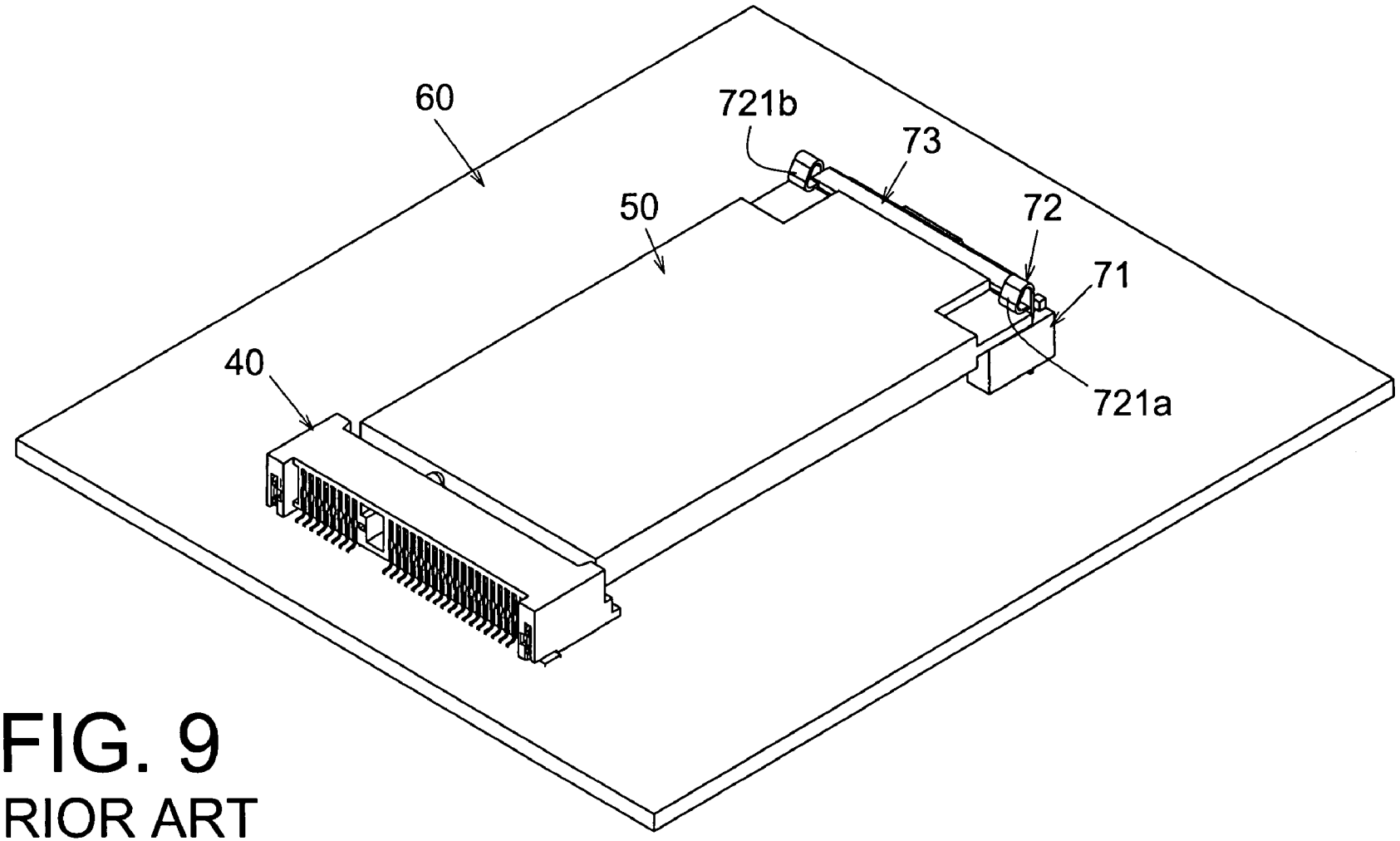
FIG. 9 PRIOR ART
FIG. 9 shows that an electronic card is chucked by the conventional fixing/grounding unit.

The bottom of the substrate section 11 of the base seat 10 is electroplated and then soldered or locked on the circuit board 60 to connect with the grounding circuit of the circuit board 60. Therefore, the conventional grounding member 73 shown in FIG. 6 is no more necessary.

Referring to FIGS. 1 to 5, two sides of the substrate section 11 of the base seat 10 are respectively bent to form two reverse U-shaped platform sections 111, whereby an electronic card 50 can be bridged between the platform sections 111. In the case that the electronic card 50 is required to be installed at a different height, in manufacturing, a manufacturer only needs to change the size of the material of the platform sections 111. Accordingly, the material with a different size can be bent into a platform section 111 with a different height to meet the requirement. In contrast to the conventional fixing/grounding unit for the electronic card, it is unnecessary to develop another set of injection molds for forming the plastic platform sections with a different height and redesign the grounding member. Therefore, the manufacturing cost can be lowered.

In the fixing/grounding unit for the electronic card of the present invention, the first chucking member 20 is integrally made from a metal board. The first chucking member 20 has a U-shaped fixing insertion section 21 which is resiliently tightly plugged in the first side of the fitting cavity 12. The fixing insertion section 21 is formed with a locating latch hook 213 which is latched in the latch hole 122 of the wall 121 of the fitting cavity 12. The first chucking member 20 further has a clip arm windingly longitudinally extending from a first free end 211 of the fixing insertion section 21. The clip arm 22 and the first free end 211 of the fixing insertion section 21 define a resilient clip fissure 220 in which the first side of the wall 121 of the fitting cavity 12 is resiliently tightly clamped. The clip arm 22 is formed with a latch hole 222 in which the locating projection 123 of the wall 121 is latched. The first chucking member 20 further has a resilient pressing projecting section 23 windingly extending from a second free end 212 of the fixing insertion section 21. When the fixing insertion section 21 is inserted in the first side of the fitting cavity 12, the resilient pressing projecting section 23 is positioned above the platform section 111 in alignment therewith. Accordingly, the electronic card 50 can be tightly clamped between the resilient pressing projecting section 23 and the platform section 111. Moreover, the second free end 212 serves to push the electronic card 50 toward the terminal connector 40 of the circuit board 60, whereby the electronic card 50 can be stably inserted in the terminal connector 40.

In the fixing/grounding unit for the electronic card of the present invention, the second chucking member 30 is integrally made from a metal board. The second chucking member 30 has a U-shaped fixing insertion section 31 which is resiliently tightly plugged in the second side of the fitting cavity 12. The fixing insertion section 31 is formed with a locating latch hook 313 which is latched in the latch hole 122 of the wall 121 of the fitting cavity 12. The second chucking member 30 further has a clip arm 32 windingly longitudinally extending from a first free end 311 of the fixing insertion section 31. The clip arm 32 and the first free end 311 of the fixing insertion section 31 define a resilient clip fissure 320 in which the second side of the wall 121 of the fitting cavity 12 is resiliently tightly clamped. The clip arm 32 is formed with a latch hole 322 in which the locating projection 123 of the wall 121 is latched. The second chucking member 30 further has a resilient pressing projecting section 33 windingly extending from a second free end 312 of the fixing insertion section 31. When the fixing insertion section 31 is inserted in the second side of the fitting cavity 12, the resilient pressing projecting section 33 is positioned above the platform section 111 in alignment therewith. Accordingly, the electronic card 50 can be tightly clamped between the resilient pressing projecting section 33 and the platform section 111.

Figure 2:
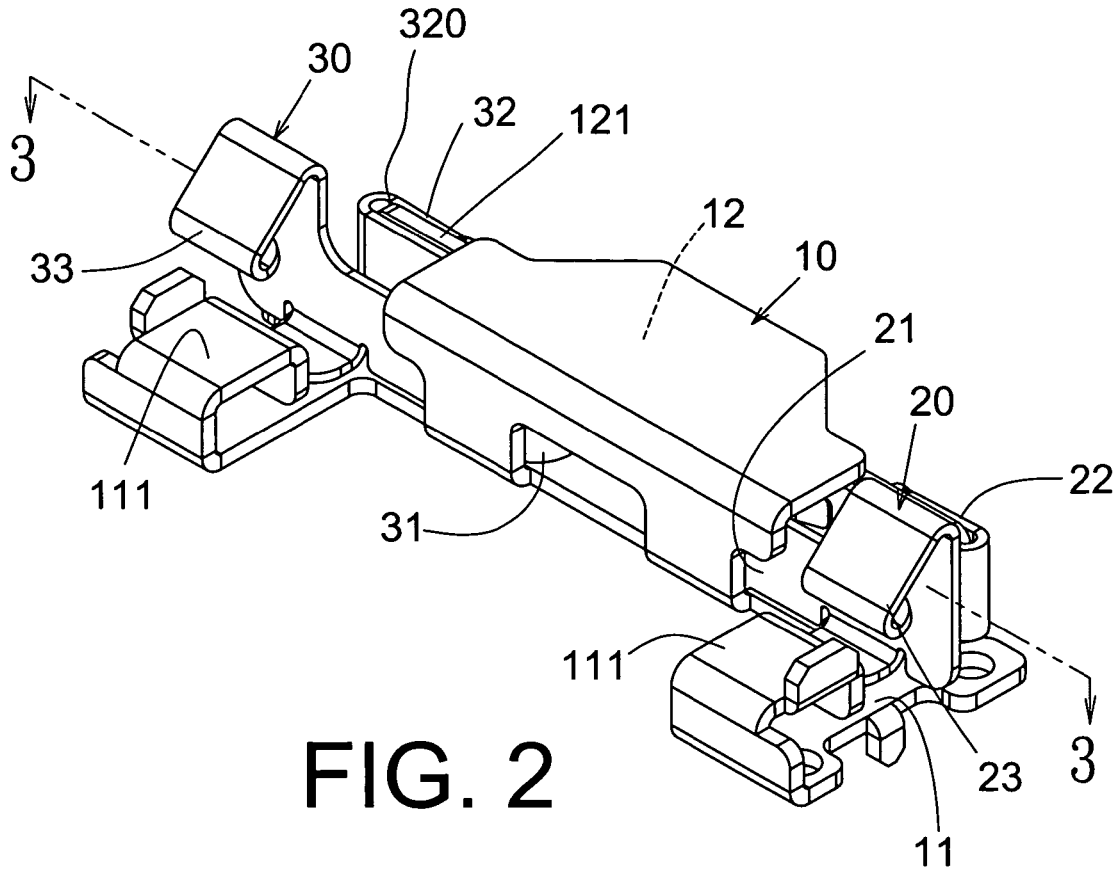
FIG. 2 is a perspective assembled view of the present invention.

Referring to FIGS. 1 to 3, when assembled, the first and second chucking members 20, 30 are respectively plugged into the two sides of the fitting cavity 12 of the base seat 10 to complete the assembly. This procedure can be quickly and easily performed. In application, when the electronic card 50 is placed into the fixing/grounding unit of the present invention, the resilient pressing projecting sections 23, 33 of the first and second chucking members 20, 30 are independently pushed as shown by the phantom line of FIG. 3. Therefore, even though the electronic card 50 is placed into the fixing/grounding unit in a biased state to first push one of the first chucking member 20 and the second chucking member 30, the other of the first and second chucking members 20, 30 will not be biased and displaced into the position of the installed electronic card 50. Therefore, the electronic card 50 can be smoothly placed in.

According to the above arrangements, the fixing/grounding unit for the electronic card of the present invention has the following advantages:

1. The base seat 10, the first chucking member 20 and the second chucking member 30 are all made from metal board. In addition, the first and second chucking members 20, 30 are resiliently tightly latched with the base seat 10 so that the grounding effect is stable and good.

2. The first and second chucking members 20, 30 are respectively independently plugged in two sides of the fitting cavity 12 of the base seat 10. Therefore, the first and second chucking members 20, 30 are not easy to deform. In addition, the electronic card 50 will not be hindered from being installed.

3. The structure is simple and the components are easy to assemble.

4. The base seat 10 and the first and second chucking members 20, 30 are all made from metal board and have better strength. Therefore, the using life is longer.

5. In the case that the electronic card 50 is required to be installed at a different height, in manufacturing, a manufacturer only needs to change the size of the material of the platform sections 111. Accordingly, the material with a different size can be bent into a platform section 111 with a different height to meet the requirement. In contrast to the conventional fixing/grounding unit for the electronic card, it is unnecessary to develop another set of injection molds for forming the plastic platform sections with a different height and redesign the grounding member 73 in accordance with the platform section 111. Therefore, the manufacturing cost can be lowered.

The above embodiments are only used to illustrate the present invention, not intended to limit the scope thereof. Many modifications of the above embodiments can be made without departing from the spirit of the present invention.

What is claimed is:

1. A fixing/grounding unit for electronic card, comprising:

(a) a base seat integrally made of metal board, the base seat having a substrate section bridged over a grounding circuit of a circuit board, a middle portion of the substrate section being formed with a transverse fitting cavity;

(b) a first chucking member integrally made of metal board, the first chucking member having a fixing insertion section snugly tightly inserted in a first side of the fitting cavity of the base seat, a resilient pressing projecting section extending from the fixing insertion section, whereby an electronic card can be tightly clamped between the substrate section of the base seat and the resilient pressing projecting section; and (c) a second chucking member integrally made of metal board, the second chucking member having a fixing insertion section snugly tightly inserted in a second side of the fitting cavity of the base seat, a resilient pressing projecting section extending from the fixing insertion section, whereby the electronic card can be tightly clamped between the substrate section of the base seat and the resilient pressing projecting section.

2. The fixing/grounding unit for the electronic card as claimed in claim 1, wherein two sides of a wall of the fitting cavity are respectively formed with latch holes, the first and second chucking members being respectively formed with locating latch hooks corresponding to the latch holes, whereby the locating latch hooks of the first and second chucking members can be latched in the latch holes.

3. The fixing/grounding unit for the electronic card as claimed in claim 1, wherein two sides of the wall of the fitting cavity of the base seat are formed with locating projections, the first and second chucking members being respectively formed with latch holes corresponding to the locating projections, whereby the locating projections can be latched in the latch holes of the first and second chucking members.

4. The fixing/grounding unit for the electronic card as claimed in claim 1, wherein two sides of the substrate section of the base seat are respectively bent to form two reverse U-shaped platform sections, whereby an electronic card can be bridged between the platform sections.

5. The fixing/grounding unit for the electronic card as claimed in claim 1, wherein the first chucking member has a U-shaped fixing insertion section formed with a locating latch hook which is latched in the latch hole of the wall of the fitting cavity, the first chucking member further having a clip arm windingly longitudinally extending from a first free end of the fixing insertion section, the clip arm and the first free end of the fixing insertion section defining a resilient clip fissure in which the first side of the wall of the fitting cavity is resiliently tightly clamped, the first chucking member further having a resilient pressing projecting section windingly extending from a second free end of the fixing insertion section.

6. The fixing/grounding unit for the electronic card as claimed in claim 5, wherein the clip arm of the first chucking member is formed with a latch hole in which the locating projection of the wall of the fitting cavity is latched.

7. The fixing/grounding unit for the electronic card as claimed in claim 1, wherein the second chucking member has a U-shaped fixing insertion section formed with a locating latch hook which is latched in the latch hole of the wall of the fitting cavity, the second chucking member further having a clip arm windingly longitudinally extending from a first free end of the fixing insertion section, the clip arm and the first free end of the fixing insertion section defining a resilient clip fissure in which the second side of the wall of the fitting cavity is resiliently tightly clamped, the second chucking member further having a resilient pressing projecting section windingly extending from a second free end of the fixing insertion section.

8. The fixing/grounding unit for the electronic card as claimed in claim 7, wherein the clip arm of the second chucking member is formed with a latch hole in which the locating projection of the wall of the fitting cavity is latched.

* * * * *